United States Patent [19]

Vartoughian

[11] Patent Number: 4,710,048

[45] **Date of Patent: * Dec. 1, 1987**

[54] APPLICATOR BOTTLE WITH SEALING CAP

[76] Inventor: Victor Vartoughian, 358 N. Ridgewood Pl., Los Angeles, Calif. 90004

[ * ] Notice: The portion of the term of this patent subsequent to May 8, 2001 has been disclaimed.

[21] Appl. No.: 704,901

[22] Filed: Feb. 21, 1985

Related U.S. Application Data

[63] Continuation of Ser. No. 518,419, Jul. 29, 1983, abandoned, which is a continuation of Ser. No. 246,726, Mar. 23, 1981, Pat. No. 4,447,169.

[30] Foreign Application Priority Data

May 8, 1983 [WO] 05081983 ..... PCT/US83/01201

[51] Int. Cl.[4] ..... A46B 11/00; A45D 34/00

[52] U.S. Cl. ..... 401/269; 401/126; 401/129; 401/183

[58] Field of Search ..... 401/118, 124, 126, 129, 401/133, 186, 183, 268, 269, 270, 282, 274, 290, 207, 288, 240, 175

[56] References Cited

U.S. PATENT DOCUMENTS

| | | | |
|---|---|---|---|
| 824,688 | 6/1906 | Ferris | 401/282 |
| 985,779 | 3/1911 | Cardinet | 401/290 X |
| 2,038,057 | 4/1936 | Peters | 401/183 X |
| 2,590,329 | 3/1952 | Kromray | 401/124 |
| 2,673,362 | 3/1954 | Robinson | 401/186 |
| 2,803,028 | 8/1957 | Flynn | 401/129 |
| 2,832,981 | 5/1958 | Breuhan | 401/183 |
| 3,008,172 | 11/1961 | Thompson | 401/175 X |
| 3,195,544 | 7/1965 | Politzer | 401/183 |
| 3,341,884 | 9/1967 | Pryor | 401/282 X |
| 3,423,156 | 1/1969 | Mutschler | 401/240 |
| 4,447,169 | 5/1984 | Vartoughian | 401/269 |

FOREIGN PATENT DOCUMENTS

| | | | |
|---|---|---|---|
| 1925396 | 1/1970 | Fed. Rep. of Germany | 401/129 |
| 2211012 | 9/1973 | Fed. Rep. of Germany | 401/133 |
| 595449 | 10/1925 | France | 401/288 |
| 1207758 | 2/1960 | France | 401/183 |
| 86673 | 2/1966 | France | 401/133 |
| 594362 | 6/1959 | Italy | 401/126 |

*Primary Examiner*—Steven A. Bratlie
*Attorney, Agent, or Firm*—Sheldon & Mak

[57] ABSTRACT

An improved applicator bottle for dispensing polish, base or top coats for nails or the like automatically wherein the brush of the bottle is sealed off from the atmosphere so that it cannot dry out and the cap of the bottle can be used as an extension of the bottle to provide a handle.

9 Claims, 13 Drawing Figures

21
22
13
19
a
20
34
11
16
23
25
26
30
12
24
27
28
29
31
33
III
10
29
30
32
31
21'
18
17
X
14
15
II
36
37
b

APPLICATOR BOTTLE WITH SEALING CAP

This is a continuation of application Ser. No. 518,419, filed 7-29-83, now abandoned, which was a continuation of application Ser. No. 246,726 which was filed 3-23-81 and issued as U.S. Pat. No. 4,447,169.

BACKGROUND OF THE INVENTION

1. Field of the Invention

The invention relates to applicator bottles; and, more particularly, improvements in automatic applicators used to dispense fluids from a brush which fluids can dry out when exposed to the atmosphere.

2. Description of the Prior Art

Many dispenser bottles have been suggested over the years for dispensing various types of fluids, such as glues, solvents, nail polish, nail coatings, etc. Much effort has been made to prevent the fluids, which are applied by a brush, from drying out during periods of non-use. Further, such bottles drip fluids resulting in a messy application. In these prior art bottles, when atmospheric air entered the bottle, it dried out the brush and fluid channel such that fluid flow was restricted. There is thus a need for improvements in such dispenser bottles so that the brush does not dry up, the fluids flow freely, dripping is reduced or eliminated and means are provided for handling the bottle.

SUMMARY OF THE INVENTION

It is an object of this invention to provide an improved applicator bottle wherein fluid is dispensed from a brush and the brush is prevented from drying out during periods of non-use.

It is a further object of this invention to provide an improved dispenser bottle where dripping of fluids during use is reduced or eliminated.

It is still another object of this invention to provide an improved dispenser bottle which includes a stopper or cap which also acts as a handle.

These and other objects are preferably accomplished by providing an automatic applicator for dispensing polish, base or top coats for nails or the like wherein the brush of the bottle is sealed off from the atmosphere so that it cannot dry out and the cap of the bottle can also be used as an extension of the bottle to provide a handle.

DESCRIPTION OF THE PREFERRED EMBODIMENTS

Figures 1, 2, 3, 4, 5, 9, 10:
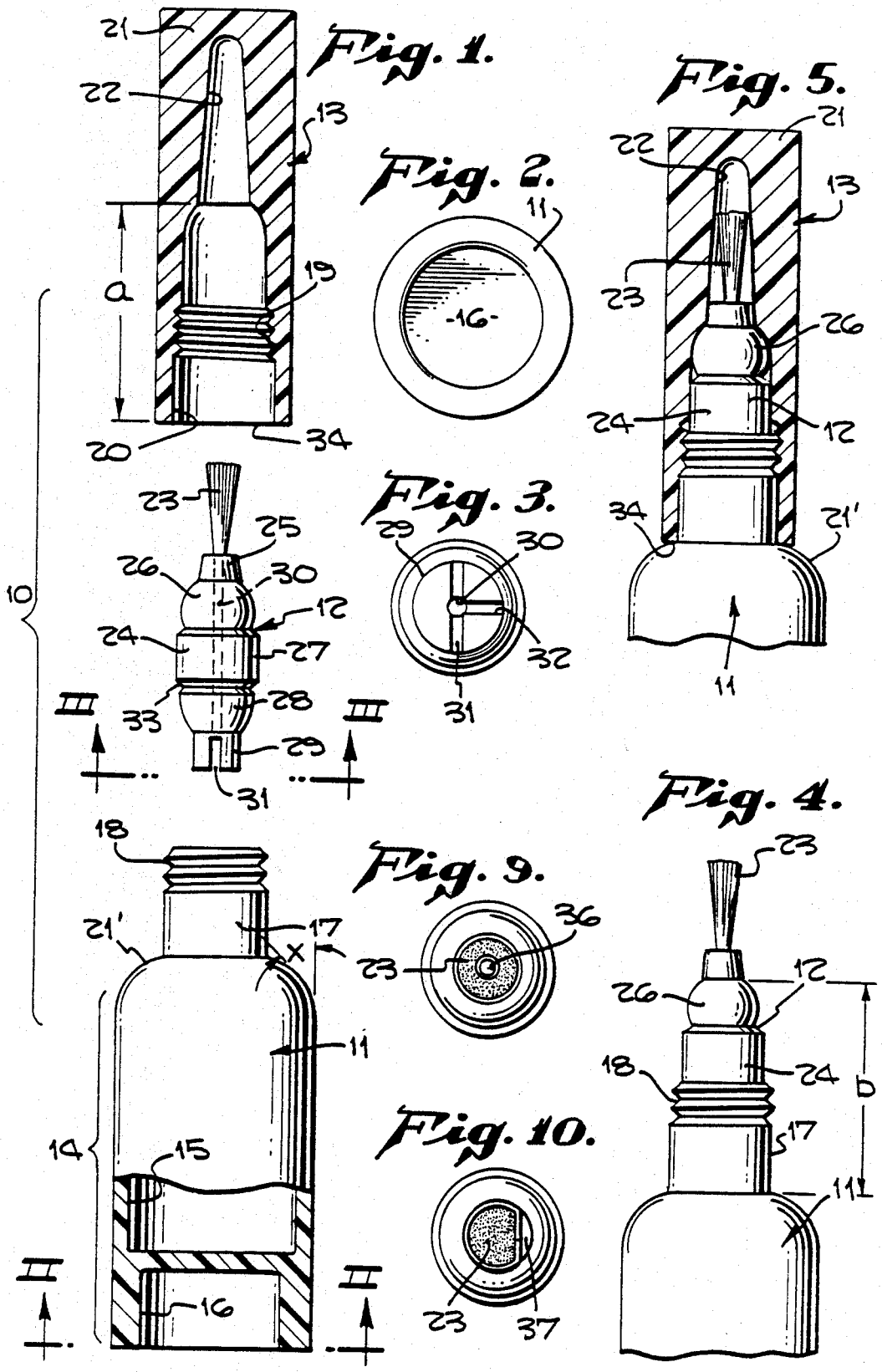
FIG. 1 is an exploded view of an automatic applicator botle in accordance with the teachings of my invention.
FIG. 2 is a view taken along lines II—II of FIG. 1.
FIG. 3 is a view taken along lines III—III of FIG. 1.
FIG. 4 is a vertical view showing the brush of FIG. 1 inserted into the neck of the bottle.
FIG. 5 is a view similar to FIG. 4 showing the cap of FIG. 1 inserted onto the bottle.
FIG. 9 is a view taken along lines IX—IX of FIG. 6 showing a modification of the brush of FIG. 1.
FIG. 10 is a view similar to FIG. 9 showing another modification of the brush of FIG. 1.

Referring now to FIG. 1 of the invention, an exploded view of an automatic applicator bottle 10 in accordance with the teachings of my invention is shown. Bottle 10 includes a main bottle body portion 11, adapted to contain therein a suitable fluid, an insertible and removable brush 12 and a cap 13. Bottle body portion 11 is preferably of a flexible transparent plastic material and, depending on the fluids dispensed from bottle 10, may be resistant to such fluids. For example, although dispenser 10 may be used to dispense any suitable fluids, such as glues, solvents, paints, etc., it is particularly useful in the dispensing of nail polish, nail base coatings, nail top coatings, etc. used in nail manicuring. Thus, at least portion 14 of bottle body portion 11 is of a squeezable material, for reasons to be discussed, and may be thin-walled at wall 15 as shown in cross-section. It may also be of acetone-resistant material. A cavity 16 (see also FIG. 2) is provided in the bottom of main body portion 11 for reasons to be discussed.

A threaded neck 17 is provided at the top of main body portion 11 opening into the interior of lower portion 14. Threads 18 are adapted to mate with like threads 19 on the inner wall 20 of cap 13. A tapered section 21' extends from neck 17 to the lower body portion 14 and is at an angle X of about 45% for reasons to be discussed.

Cap 13 may also be of a suitable material similar to that of body portion 11 and further preferably includes a solid portion 21 in the interior at the top forming an internal cavity 22, curved or angled as shown.

Brush 12 is comprised of a plurality of bristles 23 insertible in a main body portion 24. Body portion 24 includes a first tapered portion 25, into which bristles 23 are inserted in any suitable manner, and retained therein, leading to a first rounded or bulbous portion 26. Bulbous portion 26 leads to a first cylindrical section 27 which in turn is coupled to a second rounded or bulbous portion 28. Second bulbous portion 28 leads to a second cylindrical section 29, smaller in diameter than section 27, which is split as will be discussed.

As can be seen in dotted lines in FIG. 1, and in solid lines in FIG. 3, a passageway 30 extends from bristles 23 to the terminal end of section 29. Also, as can be seen in FIG. 3, section 29 has a diametrical slit 31 (see also FIG. 1). Optionally, a second slit 32 may be provided for reasons to be discussed.

The outer tapered or peripheral surface of first and second bulbous portions 26, 28 are generally related to the curvature or taper of surface 22 on the interior of cap 13. That is, such surfaces may all have a substantially 45° taper or curvature.

As shown in FIG. 4, brush 12 can be inserted into the open neck 17 of main body portion 11 by inserting portions 28 and 29 therein. The flange or portion 33 of cylindrical portion 24 (FIG. 1) acts as a stop. The distance b (FIG. 4) is related to the distance a (FIG. 1) of cap 13 so that the cap 13 can be threaded over brush 12 onto main body portion 11 with first bulbous portion 26 abutting against and conforming to surface 22 of cap 13. This is shown in FIG. 5 and it can be seen that a tight seal is provided between portion 26 and surface 22. In addition, the end 34 of cap 13 abuts against the tapered portion 21 of main body portion 11 also providing a tight seal. In this manner, cap 13 can be placed over brush 12, with brush 12 left in position for application, without air entering therein and drying out the brush bristles 23. Passageway 30 permits fluid in main body portion 11 to flow through brush 12 onto bristles 23. If desired, threads 18 may be eliminated and like threads provided on section 27, the location of threads 19 on cap 13 being adjusted accordingly.

Figure 6:
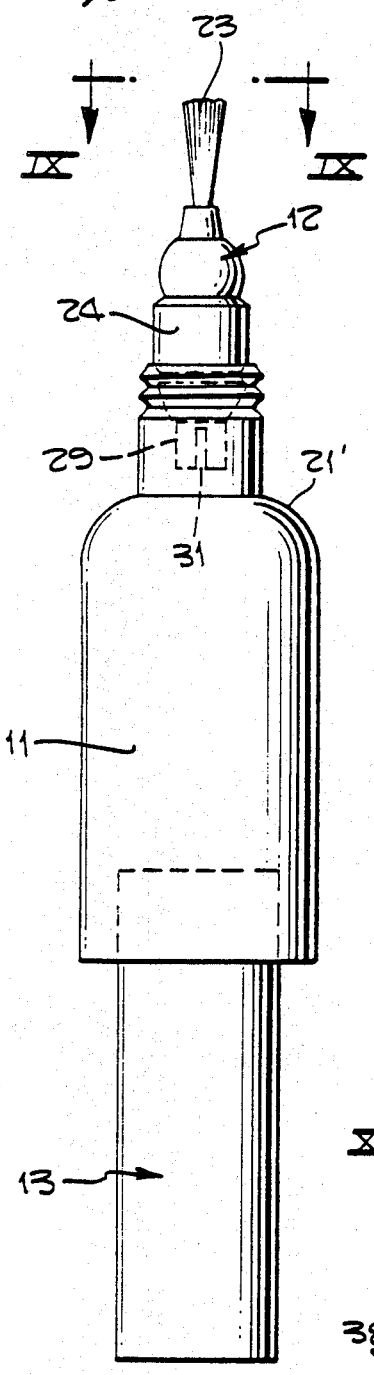
FIG. 6 is a view similar to FIG. 4 showing the cap used as a handle.

In a preferred embodiment of the invention, when the bottle 10 is in the FIG. 5 position, the cap 13 can be removed and inserted into the bottom of main body portion 11. That is, cap 13 is preferably cylindrical in cross-section and friction fits into opening or cavity 16 (which is of like cross-section) in the bottom of portion 11. Thus, as shown in FIG. 6, cap 13 is now an extension or handle portion from main bottle body portion 11 and provides an excellent means for holding bottle 10 while nail polish or the like is applied from bristles.

Figure 7:
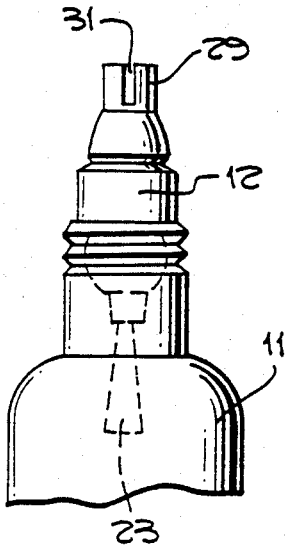
FIG. 7 is a view similar to FIG. 4 showing the brush with the bristles thereof inserted into the interior of the bottle.

After use of bottle 10, when it is anticipated that brush 12 won't be used for awhile, brush 12 can be grasped at cylindrical portion 27 and pulled out of neck 17 and reinserted with bristles 23 in the interior of main body portion 11. This is shown in FIG. 7. When cap 13 is inserted over brush 12, bulbous surface 28 engages and mates with inner surface 22 of cap 13 to again provide a tight fit. The final assembly is similar to that of FIG. 5 with the bristles extending into the interior of bottle 10.

Figure 8:
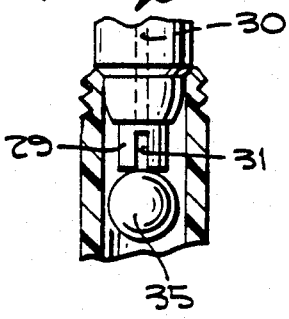
FIG. 8 is a detailed view of a portion of the assembly of FIG. 4 showing a ball entering the neck of the bottle.

Many bottles of the type for which the improvements disclosed herein generally have a small ball or the like in the liquid or fluid to agitate the same when the bottle is shaken. The split end 29, as seen in FIG. 4, prevents the ball, when it enters neck 17 as the dispenser 10 is inverted for application, from stopping fluid flow. This is illustrated in FIG. 8 wherein ball 35 is shown as abutting against the bottom of split end 29 but fluid can flow around ball 35 and enter passageway 30 through slit 31.

The optional slit 32 in FIG. 3 may be used as a keyway to orient the brush 12 during assembly. For example, in manufacturing bottle 10, brush 12 is held upright and bristles 23 inserted into end 25. If a like key is provided in the manufacturing process, receivable in keyway or slit 32, the brush 12 may be keyed in a desired orientation for automatic insertion of the bristles 23.

FIG. 9 is a modification of the bristles 23 of FIGS. 1–8. In FIG. 9, bristles 23 may surround a central opening 36 in tip or end 25 which is in fluid communication with passageway 30. Alternatively, as shown in FIG. 10, a side chamber 37 or opening may be provided in tip or end 25 also communicating with passageway 30.

Figure 11:
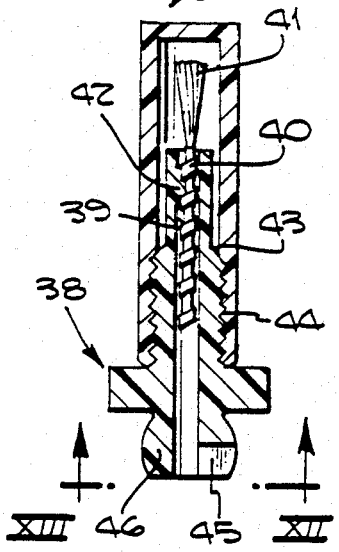
FIG. 11 is a vertical view, partly in section, of another modification of the brush of FIG. 1 with a modified cap thereon.

Another embodiment is shown in FIG. 11 wherein brush 38 is otherwise similar to brush 12 but includes an enlarged passageway 39 receiving therein a spiral 40 having bristles 41 secured therein. A protuberance 42 is provided on the inner wall of passageway 39 and enters spacing between the spirals of spiral 40 as shown to hold the bristles 41 firmly therein. Bulbous portion 26 of FIG. 1 is replaced by a tapered portion 43, which may conform to cavity 22 of cap 13 of FIG. 1, and may be externally threaded, at threads 44, for engaging threads 19 on cap 13. Split end 29 may be eliminated by providing a slit 45 in bulbous end 46, which extends a short distance up end 46, to permit fluid to circulate therethrough and up passageway 39.

Figure 13:
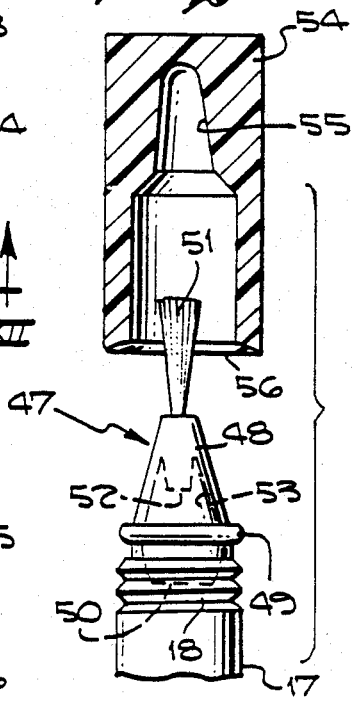
FIG. 13 is an exploded view of a modified cap and brush of the invention.
Figure 12:
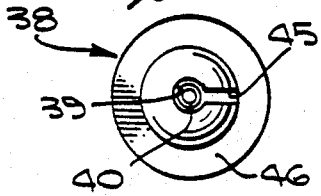
FIG. 12 is a view taken along lines XII—XII of FIG. 11.

FIG. 13 shows a modification of brush 12 of FIG. 1 wherein brush 47 has a conically shaped tip 48 leading to an annular flange 49. A tapered insert portion 50 extends from flange 49 and portion 50 is insertible into neck 17 of the main body portion 11 of the bottle of FIG. 1, flange 49 acting as a stop. Bristles 51, are retained in tip 48 in any suitable manner. As seen in dotted lines in FIG. 13, an inverted cone 52 is provided on the upper inner wall 53 of tip 48. This cone 52 prevents a ball, such as ball 35 of FIG. 8, from closing off the openings surrounding the base of cone 52 communicating with bristles 51 and controls fluid flow. Also, cap 54 may include a tapered inner surface 55 conforming to the taper of tip 48 to provide an airtight seal as previously discussed. Cap 54 may also be provided with a lower inner surface 56 conforming to surface 21 (FIG. 1) of bottle body portion 11. This provides a more effective seal. Of course, the lower end of cap 13 may be similarly formed, if desired.

Any suitable bristles may be used and inserted into the respective brush in any suitable manner. For example, bristles are known in the art which are V-shaped and a plurality are retained at the intersection of the V by an inverted staple. When the staple is inserted into the brush top, the staple retains the bristles therein.

It can be seen from the foregoing that I have disclosed improvements in automatic applicator bottles which can be squeezed to dispense fluids automatically, such as nail polish, onto brush bristles, eliminates drying of the bristles of a brush, prevents dripping, provides good fluid flow and permits the cap to serve a double function, i.e., as both a closure and as a handle. The configuration of the brush body portion prevents fluids from dripping onto the threads of the bottle body portion. Various modifications have been disclosed and others may suggest themselves to an artisan. Various materials may be used in manufacturing the components and the configurations disclosed may be varied as desired within the teachings of the invention.

I claim:

1. In an applicator dispenser bottle for dispensing a liquid or the like automatically the applicator dispenser having a brush, a liquid containing bottle body portion and a cap threadingly mounted to said bottle body portion, the improvement which comprises:

said bottle body portion being refillable and being substantially transparent and of a squeezable material, and having a neck at one end communicating with the interior thereof and a bottom at the other end with a cavity formed therein;

said brush including a bulbous closure portion for releasably and engageably fitting into said neck and a flange means for preventing said bulbous closure portion from extending more than a predetermined distance into said neck and a passageway through said closure portion;

said cap, in a first position normally closing off said neck of said bottle body portion in a fluid tight seal relationship and defining a chamber between said cap and said bulbous closure portion, said cap, in a second position, being receivably and frictionally held in said cavity to provide an extension to said bottle body portion, and said brush further including a tapered portion to one side extending only partly into said chamber when said cap is in said first position;

said brush including a plurality of bristles retained therein, said bulbous closure portion of said brush having a surface conforming annularly to the upper interior surface of said cap wherein a fluid tight seal is provided for said chamber between said cap and said bulbous closure portion of said brush when said cap is inserted over said brush and threaded onto said bottle body portion.

2. The applicator of claim 1 including an extension portion extending from said closure portion having a slotted opening at its terminal end communicating with said passageway and extending generally normal thereto.

3. The applicator of claim 1 and wherein the area of said bottle body portion adjacent said neck is tapered and said cap abuts against the tapered area of said bottle body portion when mounted on the neck thereof to provide a fluid tight seal between said cap and said bottle body portion.

4. The applicator of claim 1 wherein said passageway extends axially of said brush and provides a central opening into substantially the center of a plurality of bristles, said bristles surrounding said central opening from said passageway.

5. The applicator of claim 4, wherein said brush includes a second portion having a surface conforming to the upper interior surface of said cap whereby said brush can be inserted into the neck of said bottle body portion with bristles either entering the neck of said bottle body portion or extending thereout, the upper interior surface of said cap conforming to the surface of said second portion to provide a fluid tight seal.

6. The applicator as claimed in claim 5 wherein the closure portion is matingly secured with said neck.

7. The applicator as claimed in claim 5 wherein the closure portion is frictionally secured with said neck.

8. The applicator of claim 1 wherein said brush includes an opening adjacent a plurality of bristles communicating with a spiral substantially uninterrupted fluid flow path within said passageway.

9. An applicator as claimed in claim 1 wherein said brush includes an opening adjacent a plurality of bristles communicating a spiral substantially uninterrupted fluid flow path within said passageway, and said brush includes a second portion having a surface conforming to the upper interior surface of said cap whereby said brush can be inserted into the neck of said bottle body portion with bristles either entering the neck of said bottle body portion or extending thereout, the upper interior surface of said cap conforming to the surface of said second portion to provide a fluid tight seal, and the closure portion being matingly secured with said neck.

* * * * *